US009957717B2

(12) United States Patent
Nagan

(10) Patent No.: US 9,957,717 B2
(45) Date of Patent: May 1, 2018

(54) TERMINATION FITTING FOR A VENT TUBE

(71) Applicant: Joseph Peter Nagan, Kaukauna, WI (US)

(72) Inventor: Joseph Peter Nagan, Kaukauna, WI (US)

(73) Assignee: Silver Angels, LLC, Kaukauna, WI (US)

( * ) Notice: Subject to any disclaimer, the term of this patent is extended or adjusted under 35 U.S.C. 154(b) by 0 days. days.

(21) Appl. No.: 14/997,326

(22) Filed: Jan. 15, 2016

(65) Prior Publication Data

US 2017/0204610 A1 Jul. 20, 2017

(51) Int. Cl.

| | |
|---|---|
| ***E04C 2/52*** | (2006.01) |
| ***E04D 13/00*** | (2006.01) |
| ***F24F 7/013*** | (2006.01) |
| ***F24F 13/14*** | (2006.01) |
| ***F24F 13/06*** | (2006.01) |

(52) U.S. Cl.
CPC ..... *E04D 13/00* (2013.01); *F24F 7/013* (2013.01); *F24F 13/06* (2013.01); *F24F 13/14* (2013.01)

(58) Field of Classification Search
CPC ..... E04D 13/00; E04D 247/013
See application file for complete search history.

(56) References Cited

U.S. PATENT DOCUMENTS 2,603,141 A 7/1952 Phillips et al.
3,105,664 A * 10/1963 Poradun ..... F16L 5/00 248/56
4,315,455 A 2/1982 Shaklee
4,335,647 A * 6/1982 Timmons ..... F24F 13/06 138/106
4,406,216 A 9/1983 Hott et al.
4,461,128 A 7/1984 Knoebl
4,665,804 A * 5/1987 Miyasaka ..... B60H 1/3428 454/315

(Continued)

FOREIGN PATENT DOCUMENTS

GB 2209070 4/1989

OTHER PUBLICATIONS

Wytmar, David: Constructing Eaves—Sequencing, http://housedesignmanual.blogspot.com/2013/02/constructing-eaves-sequencing.html. 20 pages.

(Continued)

*Primary Examiner* — Patrick J Maestri
(74) *Attorney, Agent, or Firm* — Brannen Law Office, LLC

(57) ABSTRACT

The present invention relates to a termination fitting that is mountable adjacent to, but independent of, and before installation of, the soffit. The termination fitting has a mounting bracket, a vent body, a damper assembly and a diffuser. The mounting bracket has a base attachable to a vertical surface and a retainer that can have a generally arc shaped outer wall. The vent body has an inlet end and an outlet end. The outlet end is attachable to the retainer in a rotatable and lockable manner. The damper assembly is connected to the inlet end of the vent body and has a damper housing and a damper. The damper housing has a face that is held in an inclined place to hold the damper in the inclined plane when in a resting position. The diffuser is rotatable relative to the vent body.

18 Claims, 14 Drawing Sheets

(56) References Cited

U.S. PATENT DOCUMENTS

| | | | | |
|---|---|---|---|---|
| 4,927,103 | A * | 5/1990 | Nicholson | F16L 3/13 138/106 |
| 5,092,915 | A * | 3/1992 | Lackner | A47L 9/1427 15/351 |
| 5,165,732 | A | 11/1992 | Townsend | |
| 5,167,578 | A | 12/1992 | Legault | |
| 5,476,183 | A | 12/1995 | Harpenau | |
| 5,498,204 | A | 3/1996 | Anderson et al. | |
| 5,735,084 | A | 4/1998 | Zaccagni et al. | |
| 5,762,551 | A | 6/1998 | Lachapelle et al. | |
| 5,791,985 | A | 8/1998 | Schiedegger et al. | |
| 6,019,678 | A | 2/2000 | Takahashi | |
| 6,138,418 | A | 10/2000 | Dyer et al. | |
| 6,149,516 | A | 11/2000 | Mantyla | |
| 6,287,191 | B1 | 9/2001 | Barker, II | |
| 6,443,834 | B1 | 9/2002 | Berger | |
| 6,767,280 | B1 | 7/2004 | Berger | |
| 6,866,579 | B2 | 3/2005 | Pilger | |
| 6,893,339 | B1 | 5/2005 | Berger | |
| 7,497,774 | B2 | 3/2009 | Stevenson et al. | |
| 7,980,266 | B2 | 7/2011 | Niedermair | |
| 9,157,652 | B2 | 10/2015 | Chamness | |
| 2002/0006774 | A1 | 1/2002 | Kilburn et al. | |
| 2006/0112828 | A1 | 6/2006 | Ehlers | |
| 2007/0123161 | A1 | 5/2007 | Pilger | |
| 2008/0011928 | A1 | 1/2008 | Adrian et al. | |
| 2011/0151766 | A1 | 6/2011 | Sherman et al. | |
| 2011/0183600 | A1 * | 7/2011 | Chua | F24F 7/06 454/358 |
| 2011/0312265 | A1 | 12/2011 | Leblanc | |
| 2012/0052792 | A1 | 3/2012 | Sinur et al. | |
| 2013/0196589 | A1 | 8/2013 | Ramsay et al. | |
| 2015/0031282 | A1 | 1/2015 | Nagan | |

OTHER PUBLICATIONS

Branz: Eaves, gable and guttering, Renovate, the technical resource for industry, http://www.renovate.org.nz/1970s/roofs/eaves-gables-and-guttering/. 3 pages.

Primex: Terminator, brochure, date unknown. 2 pages.

* cited by examiner

TERMINATION FITTING FOR A VENT TUBE

BACKGROUND OF THE INVENTION

1. Field of the Invention

The present invention relates to a termination fitting for a vent tube and in particular to a termination fitting that is mountable adjacent to, but independent of, and before installation of, the soffit.

2. Description of the Related Art

Many aspects of homes and other buildings are well designed and planned out. Architects and other designers have many tools at their disposal during the design process to ensure that codes and good building practices are followed. One such building practice relates to the size of fans in rooms such as bathrooms.

Bathroom fans are typically mounted in the ceiling of the bathroom and have a vent tube, or simply tube, connected to the fan. The tube then runs to the outside of the building. In one scenario, the tube or ductwork terminates at a soffit outside of an exterior wall.

The architects and other designers can plan a system of this type. Yet, unfortunately, even though a fan is properly sized for a room of a given size, the efficiency and effectiveness of the fan in operation can be compromised or otherwise operate in a less than optimal manner. The effectiveness of a fan system decreases as the length of the ductwork increases and as more bends are introduced into the ductwork. Further, the sharper the bend, the more the internal friction develops via movement of the gas against the walls, which further reduces effectiveness. In a situation where a tube is kinked, the exiting rate of exhaust gas can be a fraction of the cfm (cubic feet per minute) that the exhaust fan is capable of moving.

Many times, a subcontractor will install the ductwork and will leave an extra length to ensure it reaches the farthest location. This extra length of tubing or ductwork is called a tail. Yet, the tail is seldom cut off to complete the installation when being terminated at the soffit. Instead, the extra length is pushed back behind the soffit. In a best case scenario, doing this adds extra length and turns. Yet, as often is common, sharp bends and kinks are often introduced which dramatically reduce the effectiveness of fan.

In a further situation, it is common of the tube to connect to the termination fitting in a vertical manner. The tube then has a 90 degree bend at the junction between the tube and termination fitting.

Another drawback of current installation practices is that the termination may not be located where the designer intended. For example, the tube could be longer than necessary. Further, the location may end up interfering with windows or lights.

Thus, there is a need for a termination fitting for a vent tube that solves these and other problems.

SUMMARY OF THE INVENTION

The present invention relates to a termination fitting for a vent tube and in particular to a termination fitting that is mountable adjacent to, but independent of, and before installation of, the soffit. The termination fitting has a mounting bracket, a vent body, a damper assembly and a diffuser. The mounting bracket has a base attachable to a vertical surface and a retainer that can have a generally arc shaped outer wall. The vent body has an inlet end and an outlet end. The outlet end is attachable to the retainer in a rotatable and lockable manner. The damper assembly is connected to the inlet end of the vent body and has a damper housing and a damper. The damper housing has a face that is held in an inclined place offset from vertical so that the damper is held in the inclined plane when in a resting position. The diffuser is rotatable relative to the vent body wherein a grill can direct exhaust gas in a desired direction.

According to one advantage of the present invention, the termination fitting can be mounted to a fascia board (or other vertical member) prior to installation of the soffit.

According to another advantage of the present invention, mounting the termination fitting before the tube is run or laid out allows the tube to be cut to a proper length and installed directly onto the termination fitting by the HVAC or other installers. This advantageously minimizes excess length of tubing or ductwork. This also helps to minimize the total installation time and costs as additional steps or contractor trips can be eliminated.

According to a further advantage of the present invention, a damper can be installed prior to the soffit installation. This advantageously allows the termination end of the tube to be sealed from elements, debris and animals prior to soffit installation and/or during construction.

According to another advantage of the present invention, the vent body inlet end can be horizontally oriented (or angled at another angular orientation) to eliminate problems associated with vertical inlets such as kinking or a sharp tube bend. This also allows the termination fitting to be used with minimal vertical clearance (the vertical dimension of the vent housing is approximately 6 inches). The present invention advantageously can be used with soffits as small as 12 inches. Still further, the termination fitting can be installed at the fascia board which allows for the venting to be as far from the exterior wall of the structure as allowed while being soffit vented.

According to a still further advantage of the present invention, the diffuser can be removed prior to soffit installation and reinstalled after soffit installation. Alternatively, the diffuser can be first installed after the soffit is installed.

According to a still further advantage of the present invention, the retainer has a circumferentially or arc shaped outer wall. In one embodiment, the length of the wall is greater than 50% of a circle, wherein the retainer acts as a spring or clip to retain a flange of the vent body.

According to a still further advantage of the present invention, the rotational angle of the vent body relative to the mounting bracket is adjustable (preferably at least 180 degrees but could be less or even up to 360 degrees). This advantageously allows the rotational angle of the inlet end of the vent body to be oriented as desired, possibly towards the fan that which has the ductwork terminating at the termination fitting. In other situations, the vent inlet could be oriented so that sharp bends in the tube could be avoided by pointing the vent away from adjacent obstructions.

According to a further advantage of the present invention, the retainer has top and bottom tabs to vertically contain and stabilize the vent body flange. The bottom tabs can have holes to receive screws or other fastening devices to lock the vent body in the desired rotational orientation.

According to a still further advantage of the present invention, the diffuser is rotatable relative to the vent body. This advantageously allows the grill louvers or other gas directional mechanisms to direct the exhaust gasses in a desired direction such as away from a house or in a selected direction based on prevailing ambient air flow patterns. The angle of the diffuser can be locked with a screw that is received in the support of the vent body.

According to a still further advantage of the present invention, the damper housing has a face that is in an inclined plane, wherein the damper also lies in the inclined plane upon the face of the housing in the resting position. This advantageously prevents the damper from fluttering as the wind blows, yet allows the damper to open easily when the fan is operational.

According to a still further advantage of the present invention, the damper assembly has a neck. The neck has an extended length to provide adequate area to which a tube can be secured to.

According to a still further advantage of the present invention, pressure drop within an exhaust system is greatly reduced compared to traditional installation methods. Increasing the efficiency of the exhaust system not only increases comfort and desirability of a room, but also saves energy and money for the building owner as the fans need to be operational for shorter periods of time in order to accomplish their goals.

According to a still further advantage of the present invention, the damper is serviceable from outside of the soffit. This is accomplished by removing the diffuser and reaching into the vent body, and can be accomplished without removing the soffit.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
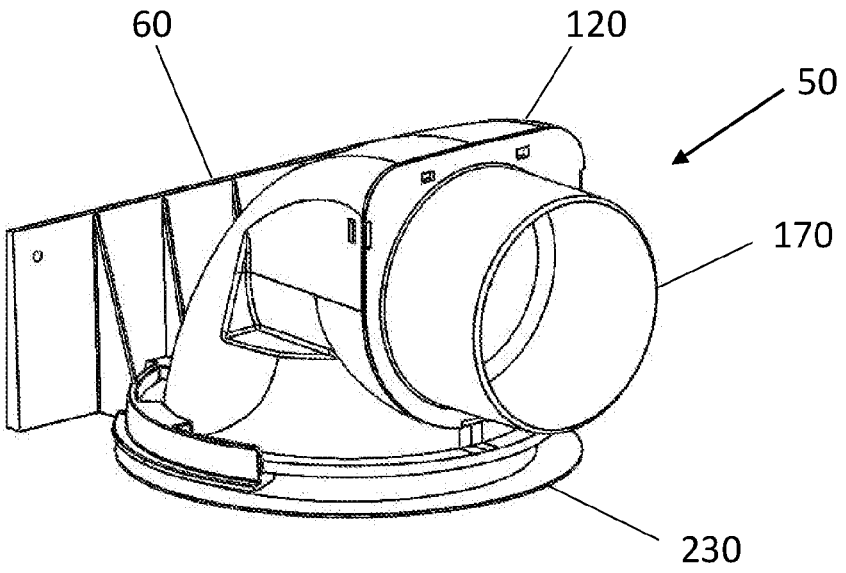
FIG. 1 is a perspective view of a termination fitting.
Figure 2:
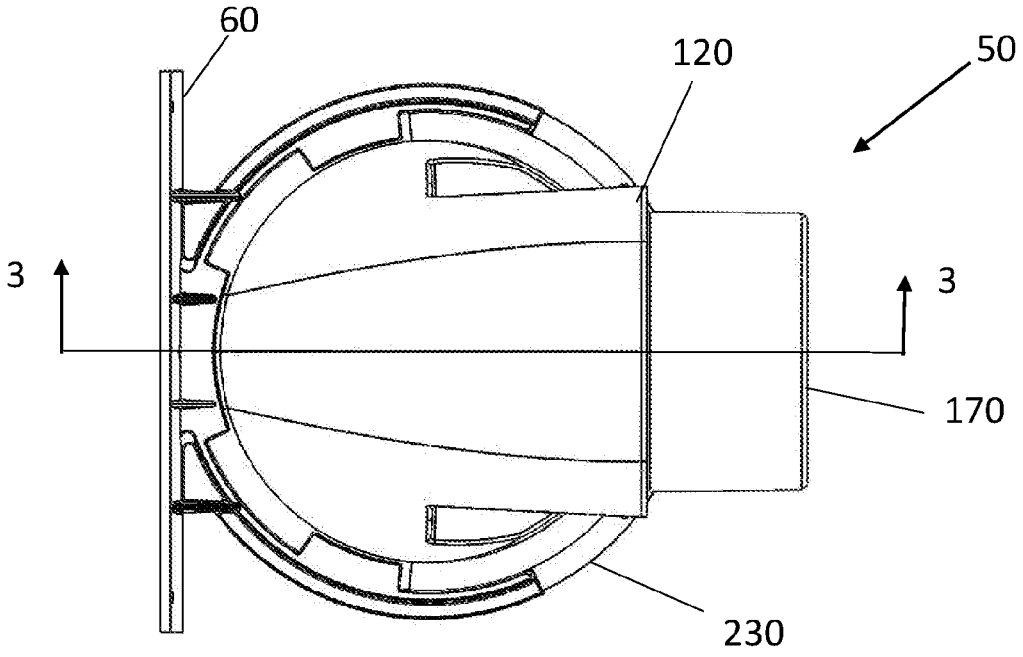
FIG. 2 is a top view of the embodiment illustrated in FIG. 1.
Figure 3:
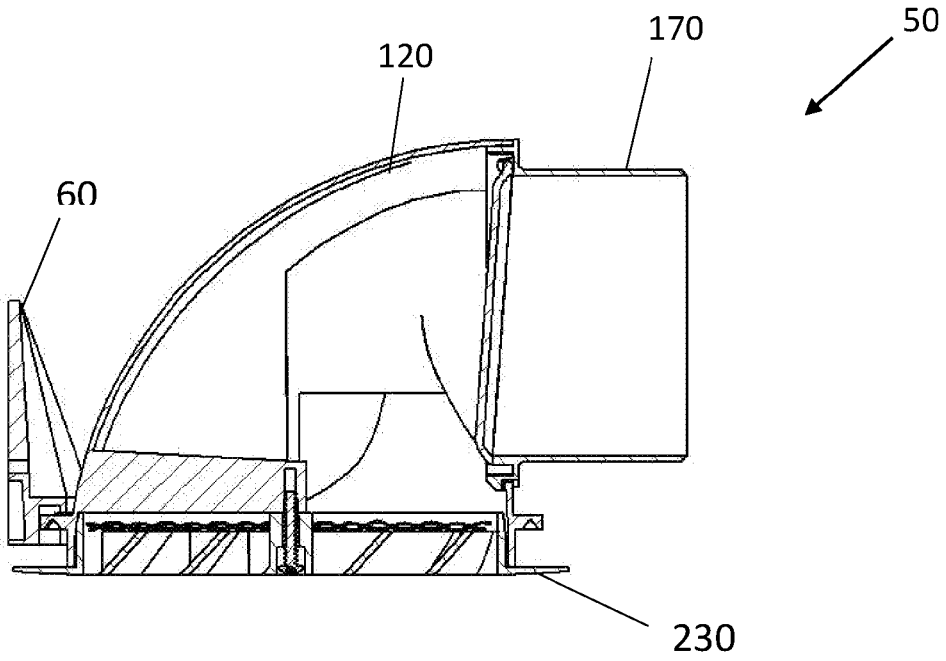
FIG. 3 is a cross-sectional view taken along line 3-3 in FIG. 2.
Figure 4:
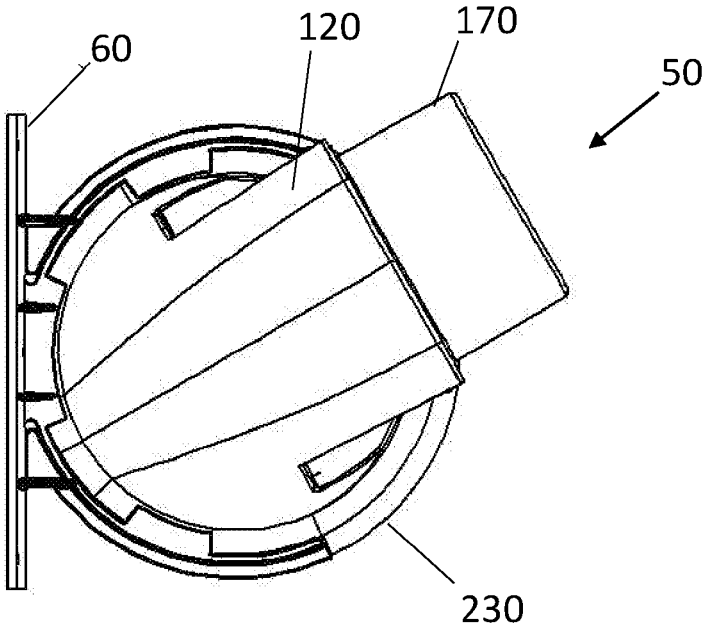
FIG. 4 is similar to FIG. 2, but shows the vent body rotated relative to the mounting bracket in a first rotational direction.
Figure 5:
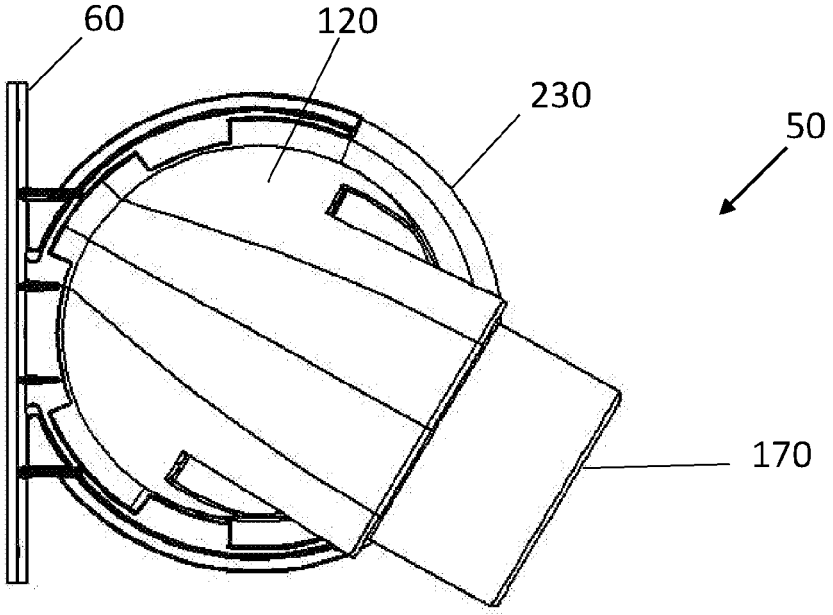
FIG. 5 is similar to FIG. 2, but shows the vent body rotated relative to the mounting bracket in a second rotational direction.
Figure 6:
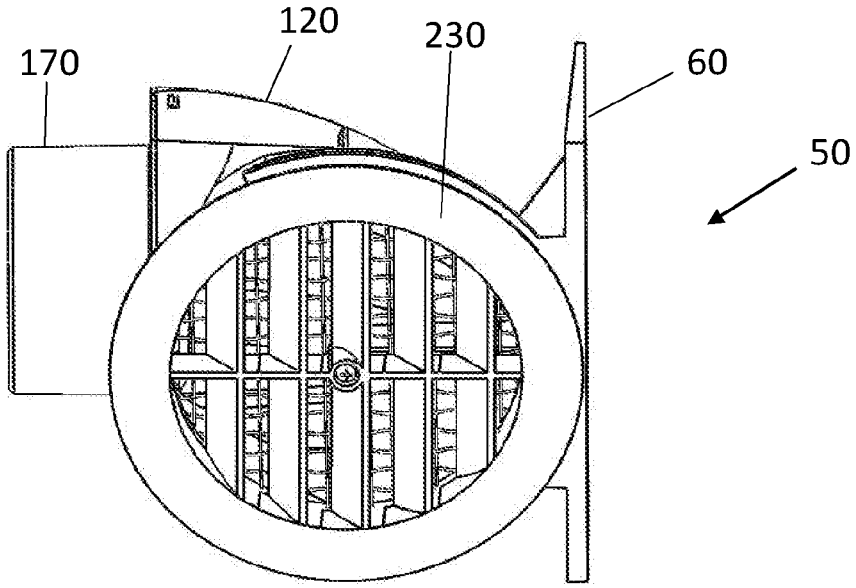
FIG. 6 is a lower perspective view of the embodiment illustrated in FIG. 1
Figure 7:
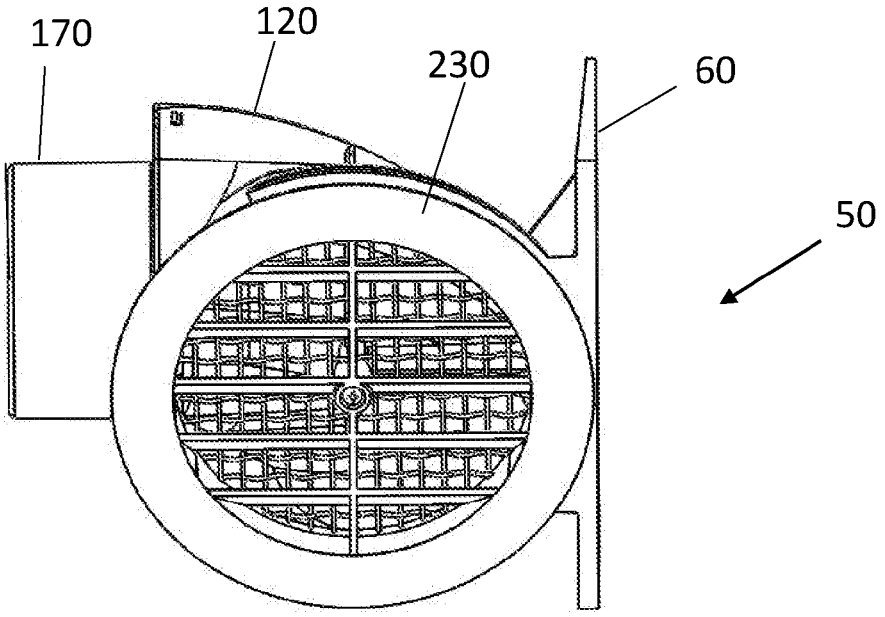
FIG. 7 is similar to FIG. 6, but shows the grill rotated relative to the mounting bracket.
Figure 8:
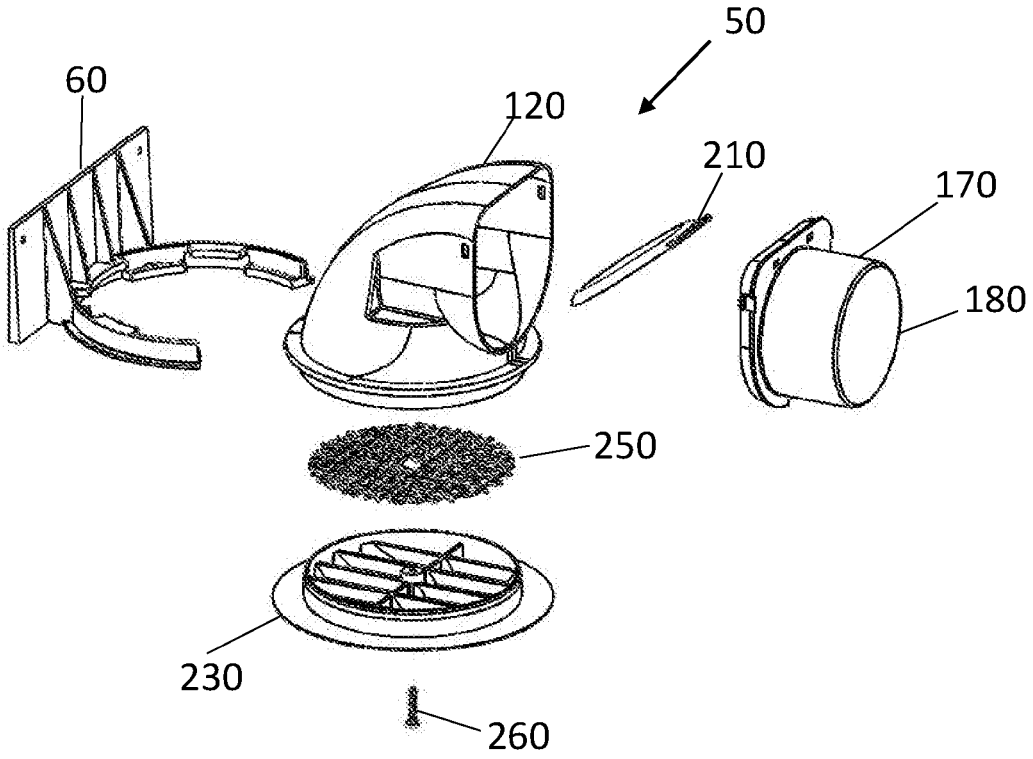
FIG. 8 is an exploded view of the embodiment illustrated in FIG. 1.
Figure 9:
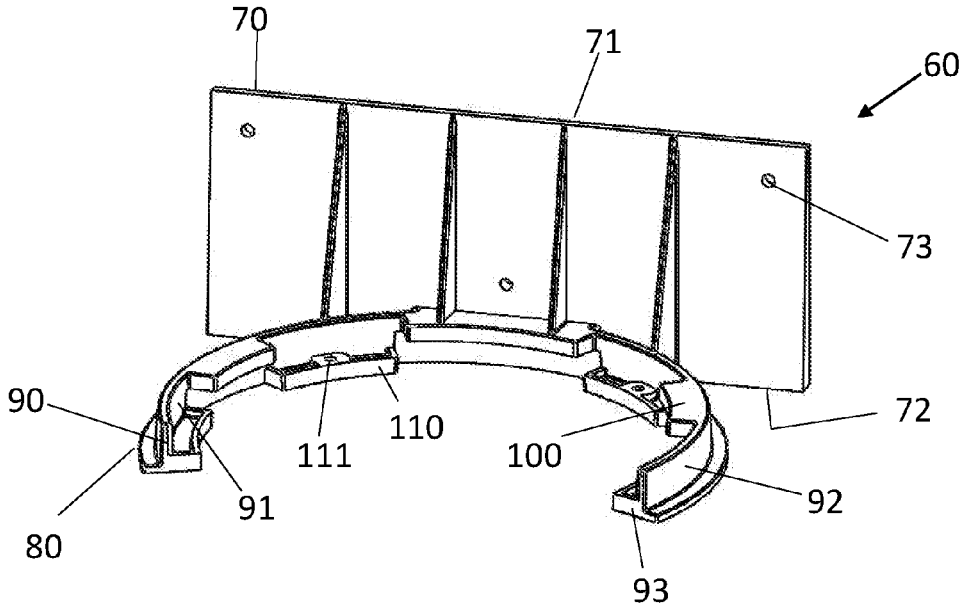
FIG. 9 is a perspective view of an embodiment of a mounting bracket.
Figure 10:
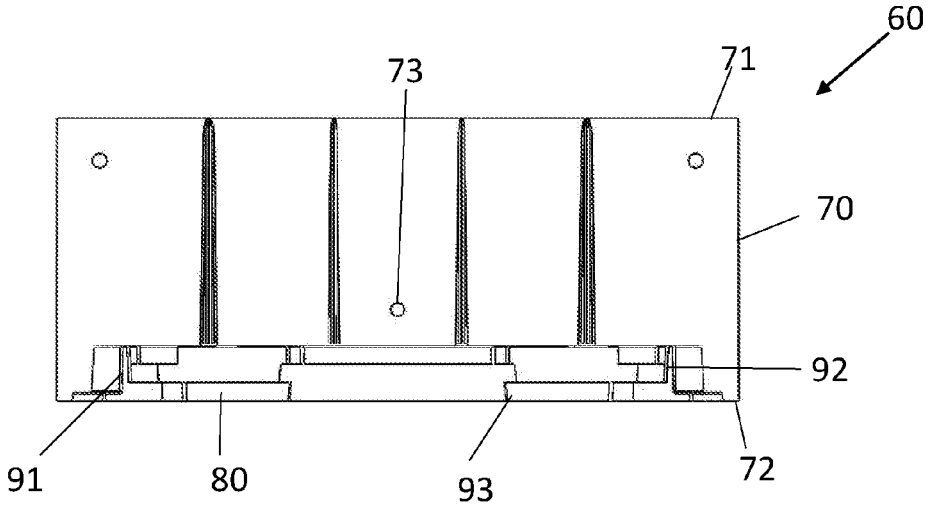
FIG. 10 is a front view of the embodiment of the mounting bracket illustrated in FIG. 9.
Figure 11:
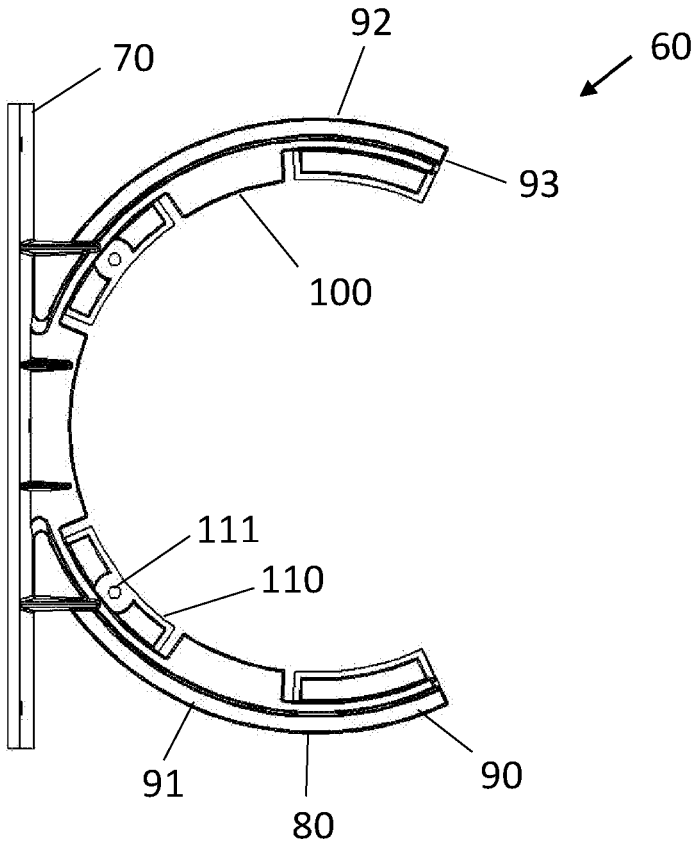
FIG. 11 is a top view of the embodiment of the mounting bracket illustrated in FIG. 9.
Figure 12:
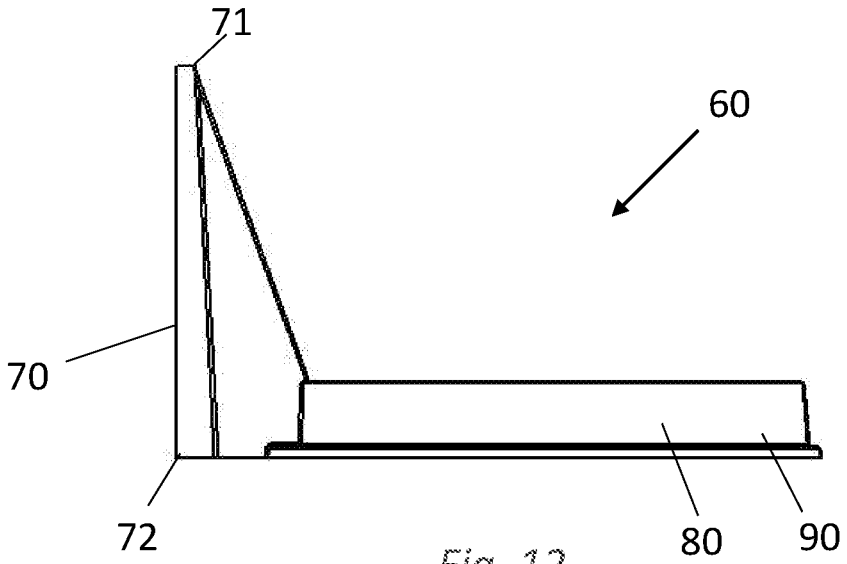
FIG. 12 is a side view of the embodiment of the mounting bracket illustrated in FIG. 9.
Figure 13:
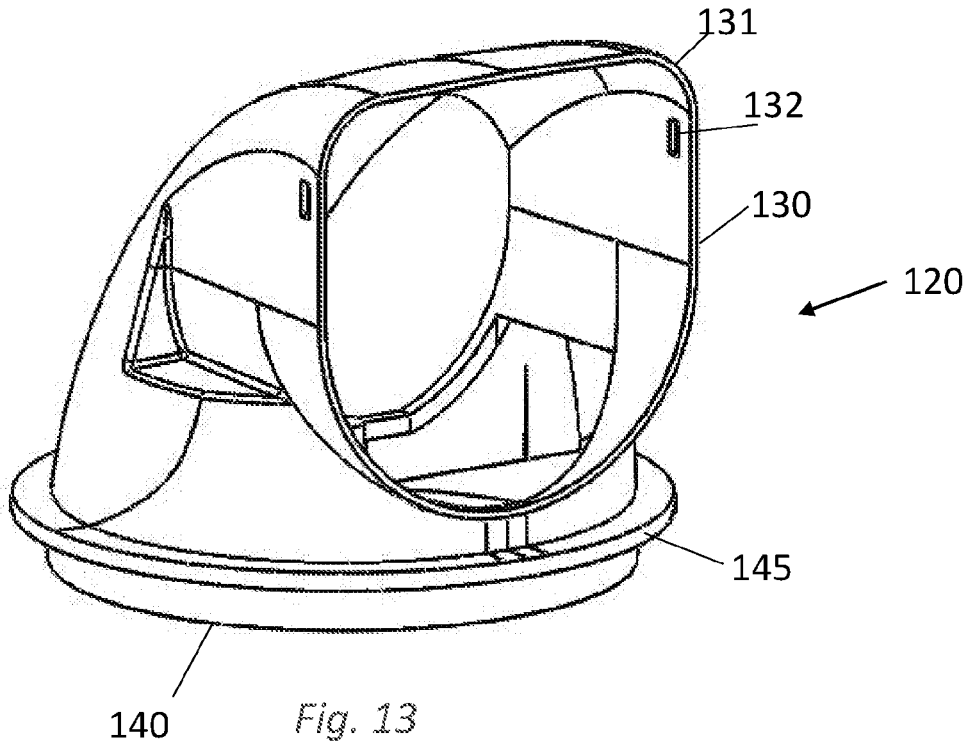
FIG. 13 is a perspective view of an embodiment of a vent body.
Figure 14:
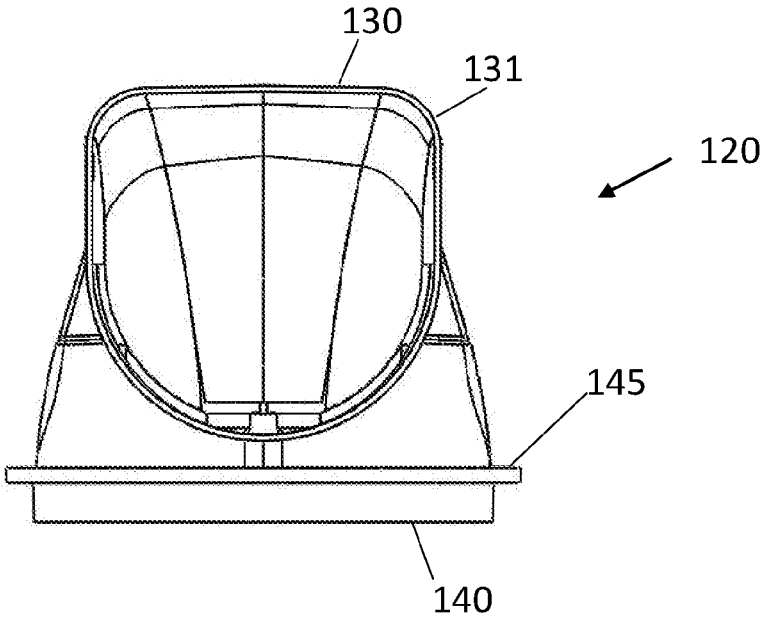
FIG. 14 is a front view of the embodiment of the vent body illustrated in FIG. 13.
Figure 15:
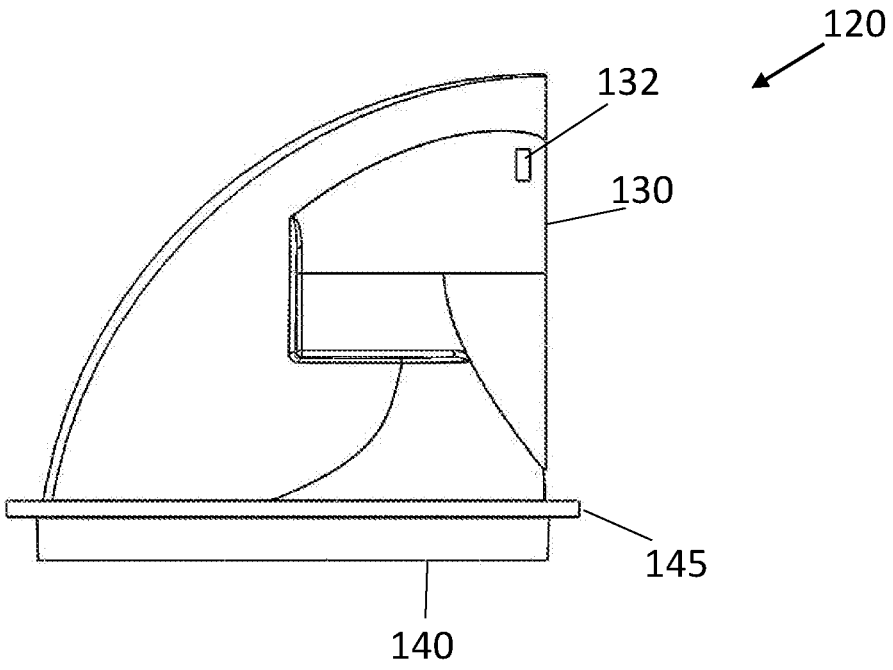
FIG. 15 is a side view of the embodiment of the vent body illustrated in FIG. 13.
Figure 16:
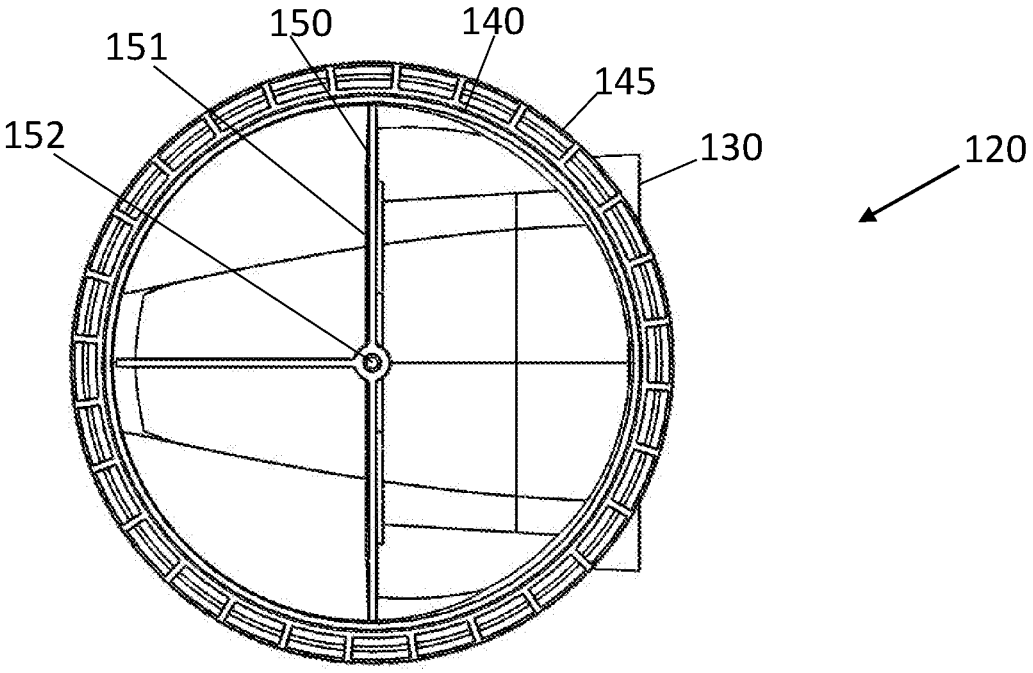
FIG. 16 is a bottom view of the embodiment of the vent body illustrated in FIG. 13.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

The present invention is useful in a building structure 5 such as a house having a room 10. The structure 5 has an exterior wall 15 with a soffit and a fascia board 21. A fan 30 can be used to vent gasses from the room 10 and exhaust the gasses at the soffit 20. A tube 35 (or vent tube or ducting) is used to span from the fan 30 to the soffit 20. The tube can be flexible or rigid.

Turning now to FIGS. 1-25, it is seen that a preferred embodiment of a termination fitting 50 of the present invention is illustrated. The termination fitting 50 can be made of several parts including a mounting bracket 60, a vent body 120, a damper assembly 170 and a diffuser 230. Each of these components can be made of various materials including but not being limited to plastic. Each of these components are described below.

Turning now specifically to FIGS. 9-12, it is seen that a preferred embodiment of a mounting bracket 60 is illustrated. The mounting bracket 60 has a base 90 and a retainer 80. The base 70 has a top 71 and a bottom 72. Holes 73 are formed through the base. The back surface or face of the base is preferably generally planar or flat. The retainer 80 is generally perpendicular to the base 70. The retainer 80 has a generally partially circumferential shaped, or arc shaped, perimeter wall 90 formed of two sides 91 and 92 respectively, with an opening 93 between distal ends of the two sides 91 and 92, respectively. The wall 90 preferably has an arc that extends greater than 50% around a perimeter of a circle that is concentric with and has the same radius as the arc. Top tabs 100 and bottom tabs 110 are provided. Holes 111 can be formed through one or more of the bottom tabs 110. One or more gussets can be provided between the base 70 and the retainer 80 to provide stiffness and strength to the mounting bracket.

It is appreciated that while the opening 93 is shown from a front view to be centrally aligned with a midpoint of the base 70 (at a maximum distance from the base), that the opening could be located elsewhere about a circle defined by the arc radius so that it is not at the maximum distance from the base 70.

It is further appreciated that the arc could have an arc length that is equal to or less than 50% of a circle circumference (same radius as arc) and still be capable of receiving a vent body.

Turning now to FIGS. 13-16, it is seen that a preferred embodiment of a vent body 120 is illustrated. The vent body 120 has an inlet end 130 with a side wall 131 with fastening openings 132 there through. The vent body 120 also has an outlet end 140 having a circumferential or round shaped flange 145 on the outside surface. The flange preferably has generally planar top and bottom surfaces. The outlet end 140 has a generally round shaped profile at the outlet. A support 150 is provided having arms 151. The arms are asymmetrically arranged, wherein three arms are provided within 180 degrees of the outlet and no arms are provided on the other 180 degrees of the outlet. A threaded hole 152 is formed at the intersection of the arms. The inside of the vent body can be accessed by a user's hand or with a tool on the side of the outlet without arms. The inlet is shown to have an opening that is generally perpendicular to an opening through the outlet. Yet, it is appreciated that other angular orientations can be provided without departing from the broad aspects of the present invention. In the illustrated embodiment, the vent body transitions from 4 inches on the inlet side to six inches at the outlet side (internal passage or opening dimensions).

Figure 17:
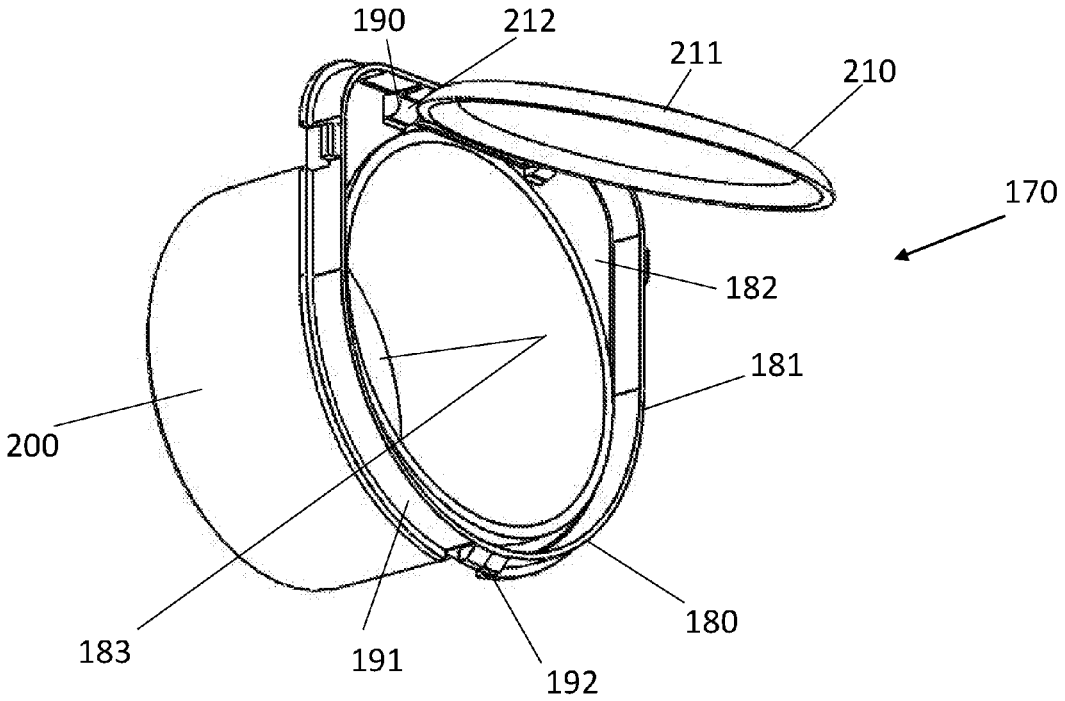
FIG. 17 is a perspective view of an embodiment of the damper assembly of the present invention.
Figure 17A:
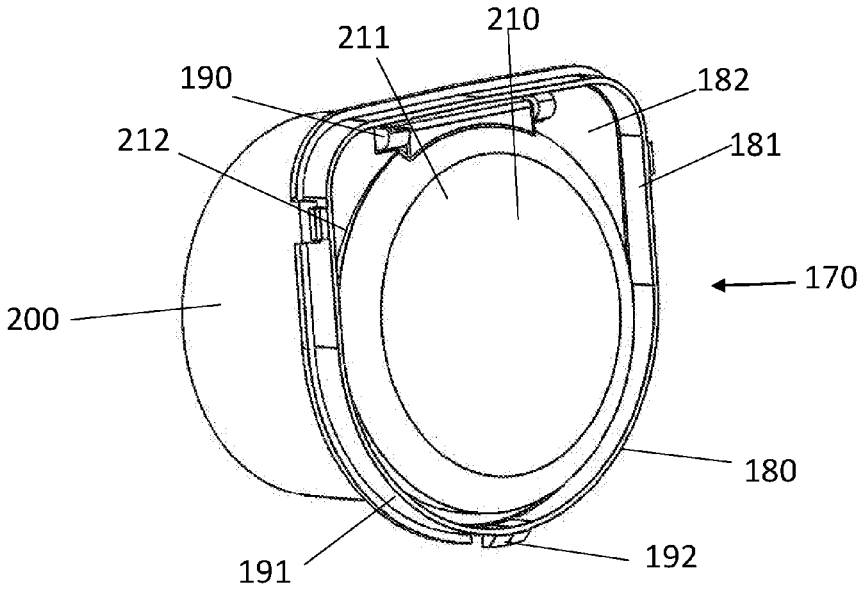
FIG. 17A is similar to FIG. 17, but alternatively shows the damper in a resting or closed position.
Figure 18:
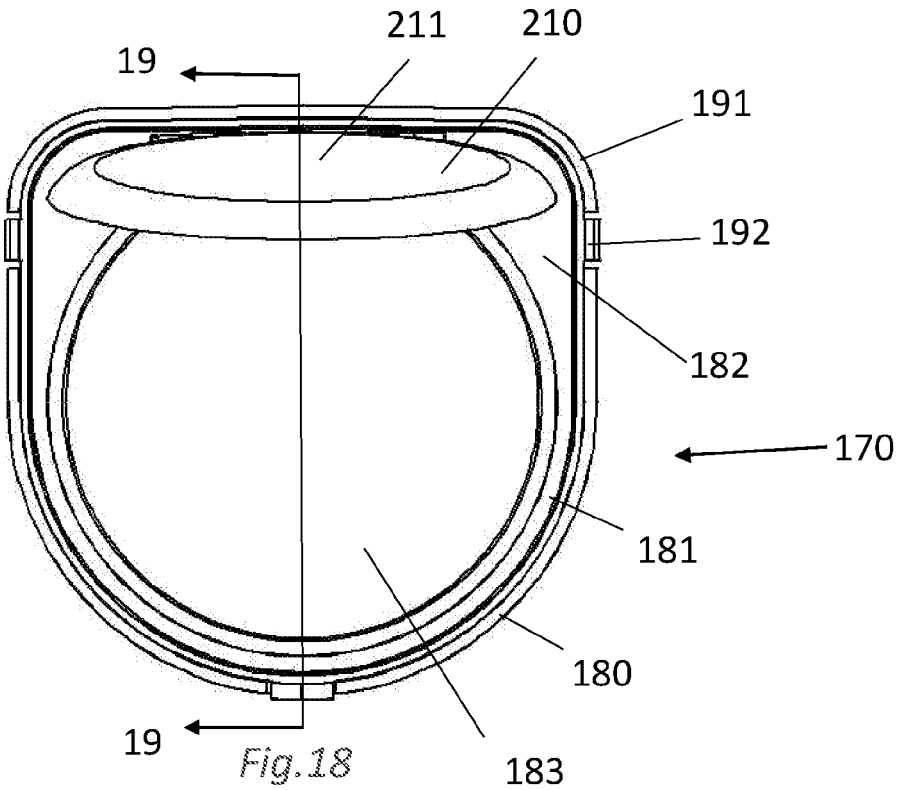
FIG. 18 is a front view of the embodiment of the damper assembly illustrated in FIG. 17.
Figure 19:
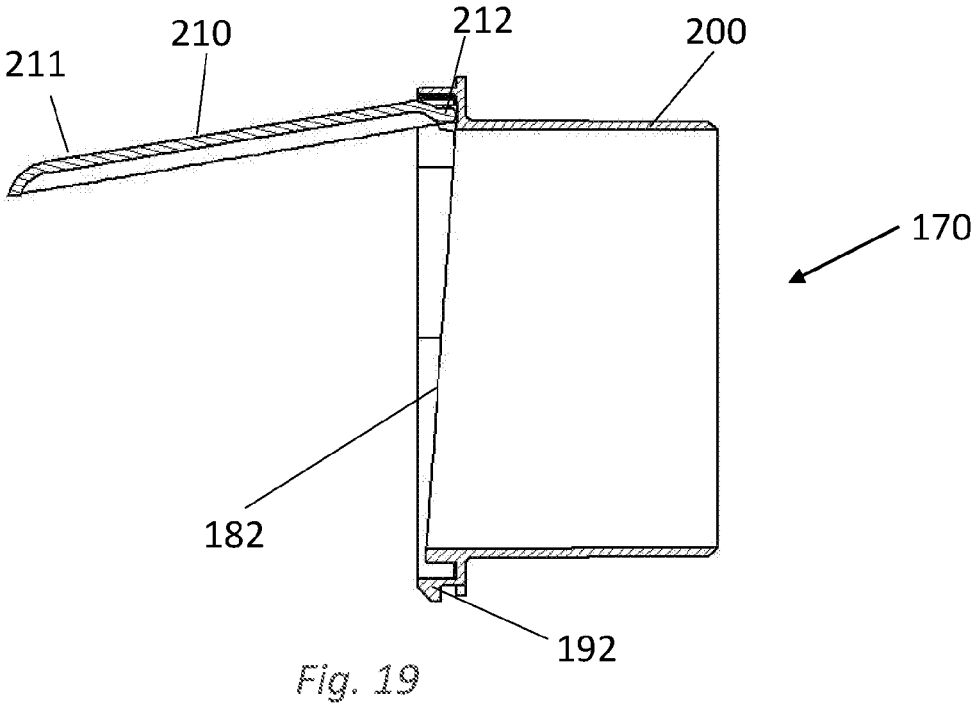
FIG. 19 is a cross-sectional view taken along line 19-19 in FIG. 18.

Turning now to FIGS. 17-19, it is seen that a damper assembly 170 is provided. The damper assembly 170 has a damper housing 180 and a damper 210. The damper housing 180 has a head 181 with a face 182 having an opening there through. The face 182 is oriented in an inclined plane wherein the top of the face in further inward towards the center of the damper assembly than the bottom of the face. The inclined plane defined by the face can be approximately 3 degrees from vertical. However, it is understood that the angle of this plane could be greater or smaller without departing from the broad aspects of the present invention. A pivot frame 190 is provided. A perimeter wall 191 with prongs 192 is further provided. A neck 200 extends from the head 181. The next preferably extends several inches from the head and has a generally circular profile that can accommodate a 4 inch duct.

A damper 210 having a body 211 and a connector 212 is provided. The connector 212 is joined with the pivot frame 190 wherein the damper 210 is pivotably connected to the damper housing 180. The body 211 has a perimeter that rests on the face 182 when the damper is in the resting or closed position. The force of exhaust gas causes the damper to open. The preferred 3 degree inclined plane allows the weight of the damper to secure the damper against the face of the damper housing to prevent fluttering, yet easily allow the damper to open with the fan is operational without having a dramatic effect of system efficiency.

Figure 20:
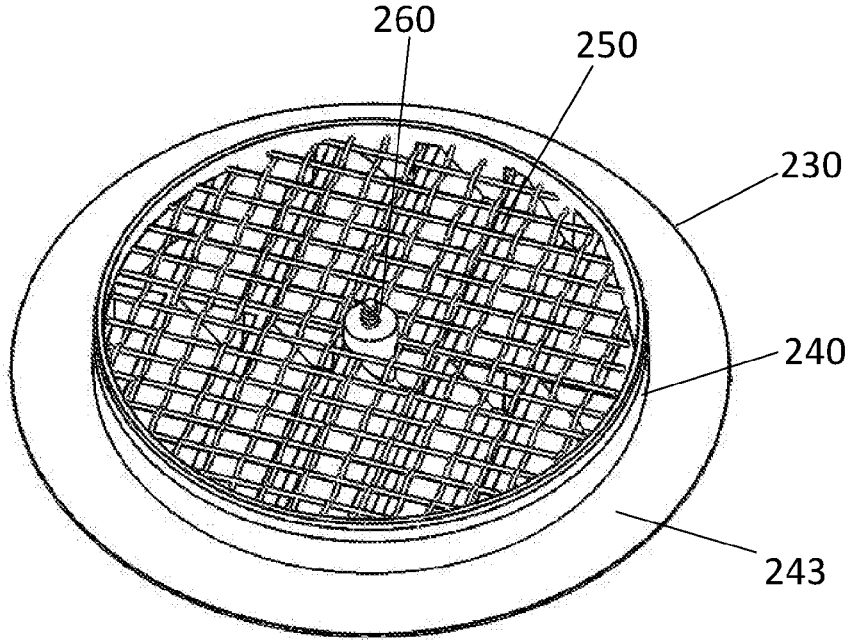
FIG. 20 is a perspective view of an embodiment of a diffuser.
Figure 21:
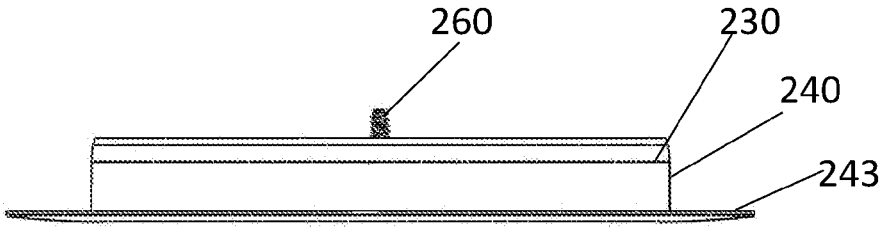
FIG. 21 is a side view of the embodiment of the diffuser illustrated in FIG. 20.
Figure 22:
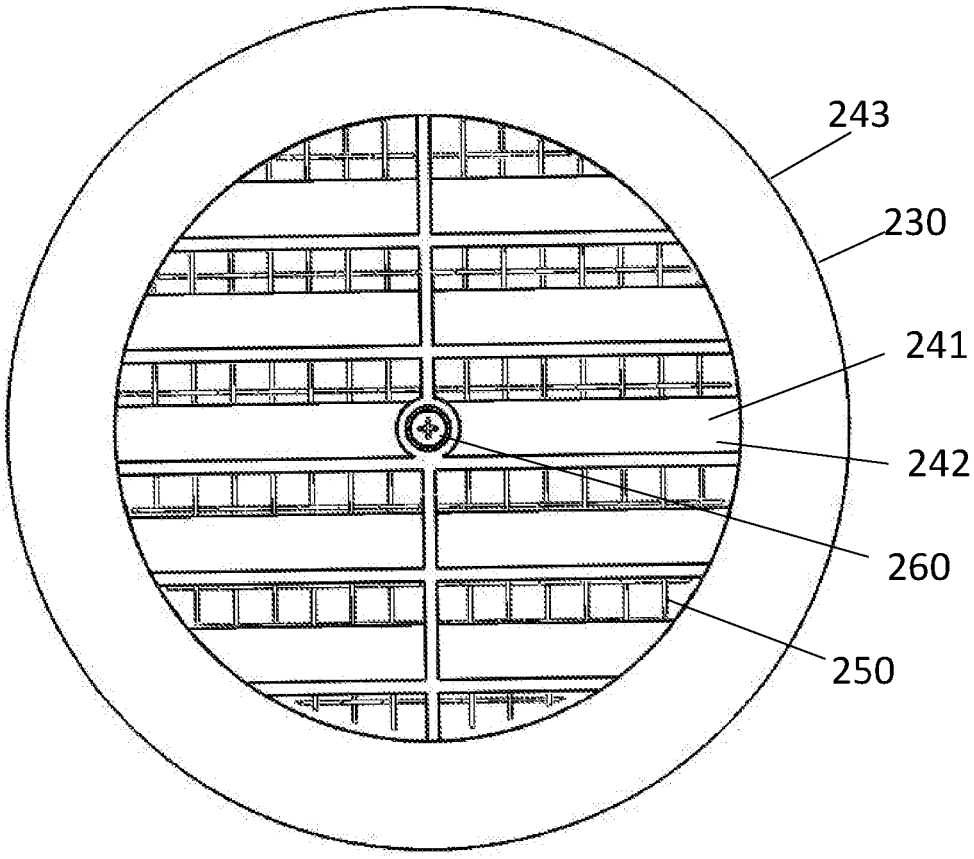
FIG. 22 is a bottom view of the embodiment of the diffuser illustrated in FIG. 20.
Figure 23:
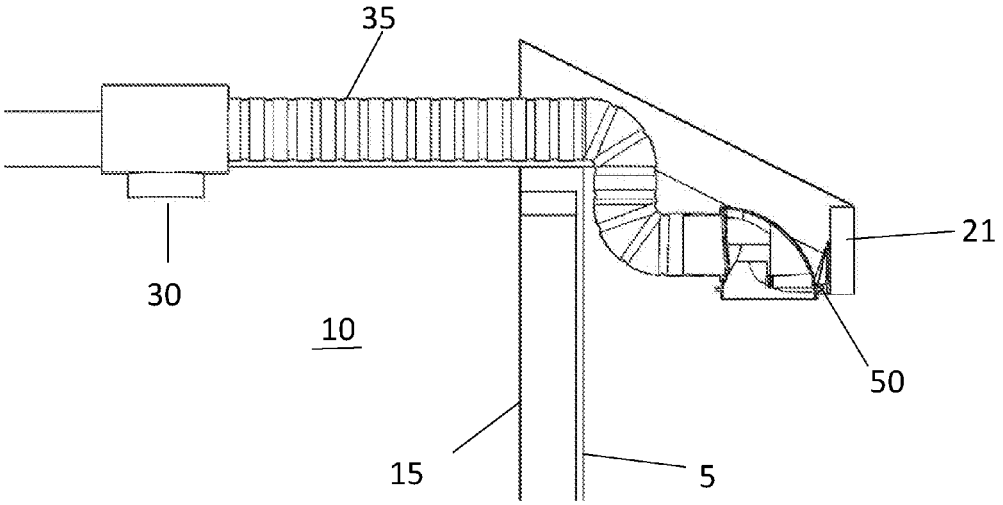
FIG. 23 is a view showing an embodiment of the present invention shown with a tube connected to it.
Figure 24:
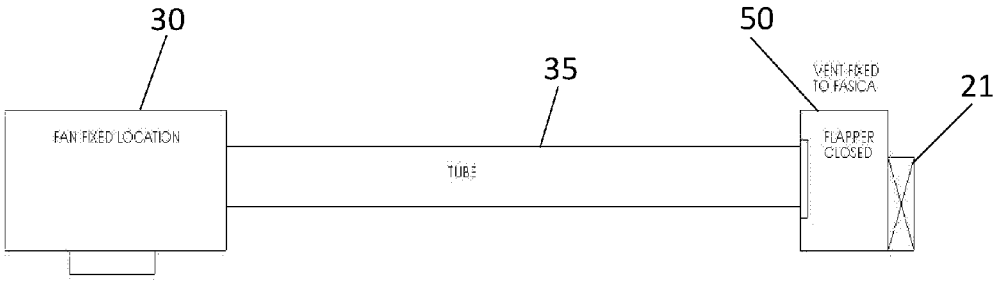
FIG. 24 is a schematic view of a use of the present invention.
Figure 25:
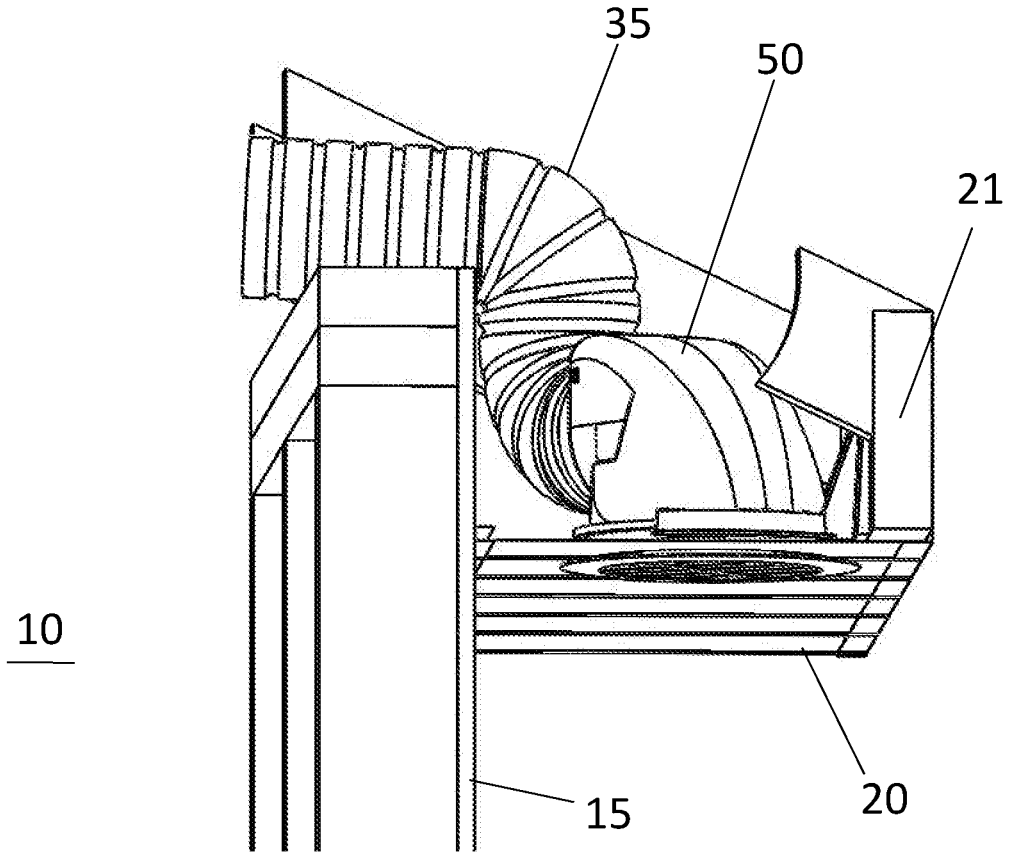
FIG. 25 is a close up view showing the present invention in an intended environment.

Turning now to FIGS. 20-22, it is seen that a preferred embodiment of a diffuser 230 is illustrated. The diffuser 230 has a body 240 that is generally circular in profile. A grill 241 is provided having louvers 242. A cap wall 243 or lip extends generally radially from the body 240 at one end of the body. A diffuser screen 250 can be provided as is a screw 260 or pin. The screw 260 passes generally centrally through the body 240. It is appreciated that round holes could be used instead of louvers.

Assembly and operation of the preferred embodiment of the present invention will now be described.

The mounting bracket 60 can be secured to a fascia board 21 or another vertical surface wherein the retainer 80 will be positioned above (and adjacent to) where a soffit 20 will be later installed. The retainer 80 is preferably horizontally oriented, wherein it will lie in a plane generally parallel to, adjacent to and above a soffit plane. When the bracket 60 is mounted to the fascia board 21, the tube termination occurs as far as possible from the building (within the confines of the soffit).

The flange 145 of the vent body 120 is held within the retainer 80 of the mounting bracket 60. This is accomplished as the sides 91 and 92 of the circumferential wall 90 are spread apart slightly so that the flange 145 can enter the retainer 80 between the top and bottom tabs 100 and 110, respectively. Then, the sides 91 and 92 resiliently spring back to hold the vent body in place within the retainer 80. The vent body can be rotated relative to the mounting bracket (preferably at least 180 degrees, but could be more up to 360 degrees or less) wherein the orientation of the inlet end 130 can be set by the user. Then, screws or other fastening elements can be driven through one or more lower tab holes 111 and into or against the flange 145 to rotationally lock the vent body in rotational orientation relative to the mounting bracket. Locking the vent body ensures that the vent body will not move later on when a grill is rotated, and will ensure that the tube does not become twisted or pull off of the neck. The locking mechanism is located above the soffit (when the soffit is installed). Hence, the locking mechanism is protected from the elements and the lock is prevented from being unintentionally unlocked from an action outside of the soffit.

The damper assembly 170 can be inserted into the inlet end 130 of the vent body, wherein prongs 192 mate with fastening openings 132 through the wall 131 of the inlet end. In this regard, the damper assembly 170 is removably secured to the vent housing. The damper 210 opens towards the downstream side of the exhaust path. The damper 210, when in the closed position, rests on the face 182 of the head 181 of the damper housing 180. Gravity holds the damper 210 on the face until a fan generates enough exhaust force to cause the damper to open. In this regard, when the damper is closed, the tube is sealed from outside elements, debris and animals. This sealing result is achieved before the soffit is installed.

The damper 210 is accessible from the outlet end 140 of the vent body, and is accessible when the soffit is in place by removing the diffuser.

The diffuser 230 is removably secured to the vent body 120. This is accomplished by inserting screw 260 through the diffuser 230 so that it is received within the threaded hole 152 of the support 150 of the vent body 120. The diffuser can rotate about an axis defined by the screw wherein the grill 241 can be oriented to a desired orientation to direct exhaust gas in a desired manner in a full 360 degrees. The cap wall 243 or extending lip covers the hole through the soffit by extending radially beyond the outer edge of the hole. The soffit is sandwiched between the diffuser and the mounting bracket. Turning the screw all of the way in locks the diffuser in the intended rotational orientation.

It is appreciated that spring clips or other securement devices could be used instead of a center screw without departing from the broad aspects of the present invention.

It is appreciated that screen 250 could optionally be removed or eliminated.

It is further appreciated that while certain sized components are illustrated herein, that other sizes and/or shapes could be used without departing from the broad aspects of the present invention.

It is appreciated that in alternative embodiments, that the damper could be removed. In such an embodiment, the tube could connect to the vent body either directly with a modified vent body or indirectly to a tube interface or other suitable structure.

In use, a set of preferred steps of installation of a preferred embodiment of the present invention comprise:

a. Mount the mounting bracket to the fascia board or other vertical surface so that the retainer is generally horizontal.
b. Slip or force the vent body into the retainer of the mounting bracket.
c. Rotate the vent body so that the inlet is at the desired angular orientation.
d. Trim tube to length and install onto neck of damper assembly.
e. Lock the vent body relative to the mounting bracket.
f. Make hole in soffit to accommodate already installed vent body.
g. Insert grill so that it sandwiches the soffit between the grill cap wall and the vent body.

A test was conducted with using six existing fittings both with 80 CFM and 110 CFM fans. Then, the same test was conducted with the termination fitting of the present invention. The results are summarized in the chart below. The pressure drops reported were measured in inches of water column "in/wc".

| Fan CFM | Fitting 1 | Fitting 2 | Fitting 3 | Fitting 4 | Fitting 5 | Fitting 6 | Average |
|---|---|---|---|---|---|---|---|
| 80 | .154 | .219 | .280 | .137 | .168 | .206 | .194 |
| 110 | .219 | .235 | .320 | .201 | .230 | .287 | .248 |
| | | | Present invention | | | | |
| 80 | | | | | | | .062 |
| 110 | | | | | | | .081 |

Thus it is apparent that there has been provided, in accordance with the invention, an invention that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A termination fitting for a tube, said termination fitting comprising:

a mounting bracket with a base and a retainer, said retainer being generally perpendicular to said base, said retainer having a perimeter opening and said retainer has a wall having a shape of an arc;

a vent body defining an air flow path and being selectably receivable within said retainer, said vent body having an inlet end and an outlet end, said inlet end being angularly offset from said outlet end so that said air flow path contains a change in direction, and said vent body being rotatable relative to said retainer, wherein said inlet end is positionable to a selected rotational position relative to said retainer and said termination fitting is usable regardless of said selected rotational position of said vent body relative to said retainer, wherein said outlet end of said vent body is laterally received through said perimeter opening in said retainer to connect said vent body to said mounting bracket, wherein said arc has a radius, said radius defining a circle with a circle perimeter, and said arc having a continuous length greater than 50% of said circle perimeter, wherein said vent body can be resiliently held by said retainer and can rotate 360 degrees relative to said retainer while being resiliently held.

2. The termination fitting of claim 1 wherein:

said vent body has a flange; and said retainer further comprises at least one top tab and at least one bottom tab, said flange being received between said at least one top tab and said at least one bottom tab when said vent body slides into said retainer, wherein said vent body is rotatable relative to said retainer while said flange is received between said at least one top tab and said at least one bottom tab.

3. The termination fitting of claim 2 wherein a fastener can be inserted through said at least one bottom tab and into said flange to lock a rotational orientation of said vent body relative to said retainer.

4. The termination fitting of claim 1 wherein said inlet end is angularly offset from said outlet end by 90 degrees.

5. The termination fitting of claim 1 further comprising a damper assembly with a damper housing and a damper, said damper housing being connected to said inlet end, and said damper housing having a neck.

6. The termination fitting of claim 5 wherein:

a plurality of support arms are at said outlet, there being an opening between two of said plurality of support arms; and said damper is accessible through said opening.

7. The termination fitting of claim 6 further comprising a diffuser with grill, said grill directing an exhaust flow in a selected direction.

8. The termination fitting of claim 7 wherein said diffuser is rotatable relative to vent body whereby a direction of exhausted gas is selectable by a user.

9. A termination fitting for receiving a terminal end of a tube connected to a fan to be exhausted through a soffit that is mounted on a vertical surface between a fascia board and an exterior wall of a structure, wherein the vertical surface could be the fascia board, said termination fitting comprising:

a mounting bracket with a base that is attachable to the vertical surface and a retainer that is perpendicular to said base, said retainer having a retainer plane and having a perimeter opening;

a vent body securable to said retainer, said vent body having a first end connectable to the tube with a first end axis parallel to said retainer plane and a second end with a second end axis perpendicular to said retainer plane when said vent body is secured to said retainer by having said second end be laterally received through said perimeter opening of said retainer; and a damper, wherein said damper seals the terminal end of the tube, wherein:

said vent body is rotatable relative to said mounting bracket within said retainer, whereby said first end is rotatable relative to said retainer and said second end axis remains parallel to said vertical surface during rotation of said first end, said termination fitting is usable regardless of a rotational position of said vent body relative to said retainer, said retainer has an arc with a radius defining a circle with a circle perimeter, said arc being a continuous arc spanning greater than 50% of said circle perimeter; and said vent body comprises a flange, said flange being resiliently received within said retainer, and said retainer further comprises at least one top tab and at least one bottom tab, said flange being received between said at least one top tab and said at least one bottom tab when said vent body is connected to said retainer, wherein said vent body is rotatable relative to said retainer while said flange is received between said at least one top tab and said at least one bottom tab.

10. The termination fitting of claim 9 further comprising a diffuser rotatably connected to said vent body.

11. A termination fitting connectable to a vertical surface above a soffit, said termination fitting comprising:

a mounting bracket connectable to the vertical surface via at least one connection hole with a connection hole axis;

a vent body having an inlet with an inlet axis that is rotatable relative to the mounting bracket, said vent body also having an outlet with an outlet axis that perpendicular to said connection hole axis when said vent body is connected to said mounting bracket, said termination fitting being operable at any position of said vent body relative to said mounting bracket; and a diffuser that is supported by said vent body and rotatable relative to said vent body, wherein:

said mounting bracket comprises a retainer, said retainer having an arc with a radius defining a circle with a circle perimeter;

said vent body comprises a flange, said flange being received within said retainer, and said retainer further comprises at least one top tab and at least one bottom tab, said flange being receivable between said at least one top tab and said at least one bottom tab, whereby said vent body is rotatable within said retainer when said flange is received between said at least one top tab and said at least one bottom tab.

12. The termination fitting of claim 11 wherein said arc has a continuous arc length that is-greater than 50% of said circle perimeter, wherein said vent body is able to be resiliently received within said retainer.

13. The termination fitting of claim 11 further comprising a damper assembly.

14. A termination fitting for a tube, said termination fitting comprising:

a mounting bracket with a base and a retainer, said retainer being generally perpendicular to said base;

a vent body defining an air flow path and being selectably receivable within said retainer, said vent body having an inlet end and an outlet end, said inlet end being angularly offset from said outlet end so that said air flow path contains a change in direction, and said vent body being rotatable relative to said retainer, wherein said inlet end is positionable to a selected rotational position relative to said retainer and said termination fitting is usable regardless of said selected rotational position of said vent body relative to said retainer, wherein:

said retainer has a wall having the shape of an arc;

said vent body has a flange; and said retainer further comprises at least one top tab and at least one bottom tab, said flange being received between said at least one top tab and said at least one bottom tab when said vent body slides into said retainer, wherein said vent body is rotatable relative to said retainer while said flange is received between said at least one top tab and said at least one bottom tab.

15. A termination fitting for receiving a terminal end of a tube connected to a fan to be exhausted through a soffit that is mounted on a vertical surface between a fascia board and an exterior wall of a structure, wherein the vertical surface could be the fascia board, said termination fitting comprising:

a mounting bracket with a base lying in a base plane that is attachable to the vertical surface and a retainer having a retainer plane that is perpendicular to said base plane;

a vent body securable to said retainer, said vent body having a first end with a first end axis parallel to said retainer plane and a second end with a second end axis perpendicular to said retainer plane and parallel to said base plane when said vent body is secured to said retainer; and a damper, wherein said damper seals the terminal end of the tube, wherein:

said vent body is rotatable relative to said mounting bracket within said retainer, whereby said first end is rotatable relative to said retainer and said second end axis remains parallel to said base plane during rotation of said first end, said termination fitting is usable regardless of a rotational position of said vent body relative to said retainer;

said retainer has an arc with a radius defining a circle with a circle perimeter, said arc being a continuous arc spanning greater than 50% of said circle perimeter; and said vent body comprises a flange, said flange being resiliently received within said retainer.

16. The termination fitting of claim 14 wherein a fastener can be inserted through said at least one bottom tab and into said flange to lock a rotational orientation of said vent body relative to said retainer.

17. The termination fitting of claim 11 wherein a fastener can be inserted through said at least one bottom tab and into said flange to lock a rotational orientation of said vent body relative to said retainer.

18. The termination fitting of claim 9 wherein a fastener can be inserted through said at least one bottom tab and into said flange to lock a rotational orientation of said vent body relative to said retainer.

* * * * *